US010217430B1

(12) United States Patent
L V

(10) Patent No.: US 10,217,430 B1
(45) Date of Patent: Feb. 26, 2019

(54) GOA CIRCUIT AND LIQUID CRYSTAL PANEL, DISPLAY DEVICE

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Xiaowen L V, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/742,165

(22) PCT Filed: Nov. 3, 2017

(86) PCT No.: PCT/CN2017/109302

§ 371 (c)(1),
(2) Date: Jan. 5, 2018

(30) Foreign Application Priority Data

Oct. 20, 2017 (CN) ..... 2017 1 0986238

(51) Int. Cl.
*G09G 3/36* (2006.01)

(52) U.S. Cl.
CPC ..... *G09G 3/3677* (2013.01); *G09G 2310/06* (2013.01); *G09G 2320/045* (2013.01)

(58) Field of Classification Search
CPC ..... G09G 3/3677; G09G 2320/045; G09G 2310/06
See application file for complete search history.

(56) References Cited

FOREIGN PATENT DOCUMENTS

CN 207020959 U 2/2018

*Primary Examiner* — Abhishek Sarma
(74) *Attorney, Agent, or Firm* — Hauptman Ham, LLP

(57) ABSTRACT

A GOA circuit is provided. The GOA circuit includes multiple cascaded GOA unit, each stage of the GOA unit is according to a N-staged GOA unit; the N-staged GOA unit comprises a pull-up control circuit, a pull-up circuit, a transmission circuit, a pull-down circuit, a pull-down holding circuit and a bootstrap capacitor; transmission the first reverse clock signal and the first clock signal of pull-down holding circuit have difference potential at each of the same clock, and the second reverse clock signal and the second clock signal of pull-down holding circuit have difference potential at each of the same clock. It could effective reverse correcting the problem of forward deflection of voltage threshold in the pull-down holding sub-circuit of single-stage GOA unit, such that enhances the reliability and stability of GOA circuit.

20 Claims, 2 Drawing Sheets

GOA CIRCUIT AND LIQUID CRYSTAL PANEL, DISPLAY DEVICE

RELATED APPLICATIONS

The present application is a National Phase of International Application Number PCT/CN2017/109302, filed Nov. 3, 2017, and claims the priority of China Application No. 201710986238.X, filed Oct. 20, 2017.

FIELD OF THE DISCLOSURE

The disclosure relates to a liquid crystal display technical field, and more particularly to a GOA (Gate Driver On Array) circuit, a display panel and a display device.

BACKGROUND

Liquid crystal display has number of advantageous such as low radiation, small volume and low power consumption, therefore widely used for products of notebook, PDA, flat television or mobile phone. The traditional liquid crystal display using outside driving chip to drive chip on the driver panel to display image. In order to reduce element numbers and decrease cost, the driving circuit structure directly be made on the display panel in recent years for example GOA technology, which integrates the grid driving circuit on glass substrate to form a scan driver on liquid crystal panel.

Comparing with traditional COF (Chip On Flex/Film) technology, the GOA technology could save a lot of manufacturing cost, and don't need bonging process of COF for Gate side, it helps enhancing yield. Therefore, GOA is a key technology of future development of liquid crystal panel.

Please refer to FIG. 1. The existing GOA circuit usually comprises multiple cascaded GOA units, each stage of the GOA unit is corresponding to a stage of a horizontal scan line. GOA unit comprises a pull-up control circuit ①, a pull-up circuit ②, a transmission circuit ③, a pull-down circuit ④ and a pull-down holding circuit ⑤, and a bootstrap capacitor ⑥ for enhancing potential. Wherein, the pull-up control circuit ① for controlling the turn-on time of the pull-up circuit ② to achieve precharging to the precharging signal Q(N), generally the previous-stage GOA unit transmits a transmission signal and a grid output signal; the pull-up circuit ② is for enhancing potential of the grid output signal G(N) and controls the turn-on of Gate; the transmission circuit ③ is for controlling turn-on or turn-off signal of the GOA unit at next-stage; pull-down circuit ④ is for pull-down the potential of Q(N), G(N) to VSS at first moment so that turn-off signal of G(N); the pull-down holding circuit ⑤ is for holding potential of Q(N), G(N) to VSS, which is negative potential, usually there has two pull-down holding module are work alternatively; the bootstrap capacitor ⑥ is for pull-up the Q(N) on second times, and its helpful output the G(N) of pull-up circuit.

The electric element of the pull-down holding circuit ⑤ is an inverter, which could be Dariington structure inverter. The single stage GOA unit of the FIG. 1 could alternative to a single stage GOA unit of the FIG. 2. Please refer to FIG. 2, usually two of the pull-down holding circuits ⑤ are alternatively work to prevent TFT T32, T42, T33, T43 be Positive Bias Stress(PBS) for long-time and made the threshold voltage Vth of element be forward deflection and cause the circuit failure.

However, two of the pull-down holding circuits ⑤ are a reverse signal LC 1 and reverse signal LC2 respectively, which is the potential of LC 1 and LC 2 are difference at the same moment. When the LC1 is a high potential, the pull-down holding circuit ⑤ positioned on left side of single-stage GOS unit is work for made the grid connected circuit point P(N) of TFT T42 and T32 stay in high potential status for a long time, such that the threshold voltage Vth of TFT T42 and T32 have forward deflection; Similarly, after a period of time, potential of LC1 and LC2 are alternative, the pull-down holding circuit ⑤ positioned on right side of single-stage GOS unit is work for made the grid connected circuit point K(N) of TFT T43 and T33 stay in high potential status for a long time, such that the threshold voltage Vth of TFT T43 and T33 have forward deflection. If repeat it again and again with the long time using signal-stage GOA unit, forward deflection of the threshold voltage Vth of TFT T32, T42, T33 and T43 become more seriously, and causes entire GOA circuit failure.

SUMMARY

A technical problem to be solved by the disclosure is to provide a GOA (Gate Driver On Array) circuit, a display panel and a display device. It could effective reverse correcting the problem of forward deflection of voltage threshold in the pull-down holding sub-circuit of single-stage GOA unit, such that enhances the reliability and stability of GOA circuit.

Furthermore, the disclosure further provides a GOA circuit comprising multiple cascaded GOA units, each stage of the GOA unit outputting a row-scan signal to a row pixel unit which corresponding to a display region in display panel according to a N-staged GOA unit; the N-staged GOA unit comprises a pull-up control circuit, a pull-up circuit, a transmission circuit, a pull-down circuit, a pull-down holding circuit and a bootstrap capacitor, and N is positive integer; wherein, the pull-down holding circuit includes a first pull-down holding sub-circuit and a second pull-down holding sub-circuit which work alternatively; wherein the first pull-down holding sub-circuit includes:

a first TFT, a drain of the first TFT is connected to a first clock signal, and a source of the first TFT is connected to a first circuit point;

a second TFT, a drain and a grid of the second TFT are connected to each other, and the drain and the grid of the second TFT both are connected to the first clock signal, a source of the second TFT is connected to a grid of the first TFT;

a third TFT, a drain of the third TFT is connected to a source of the second TFT, and a grid of the third TFT is connected to a precharge signal, a source of the third TFT is connected to a DC low voltage signal;

a fourth TFT, a drain of the fourth TFT is connected to the first circuit point, and a grid of the fourth TFT is connected the precharge signal, a source of fourth TFT is connected to the DC low voltage signal;

a fifth TFT, a drain of the fifth TFT is connected to an outputting signal of grid of the fifth TFT, and a grid of the fifth TFT is connected to the first circuit point, and a source of the fifth TFT is connected to a first reverse clock signal;

a sixth TFT, a drain of the sixth TFT is connected to the precharge signal, and a grid of the sixth TFT is connected to a first circuit point, a source of the sixth TFT is connected to the first reverse clock signal;

wherein the first reverse clock signal has difference potential between the correspondingly positioned first clock signal at the same clock;

the second pull-down holding sub-circuit includes:

a seventh TFT, a drain of the seventh TFT is connected to a second clock signal, and a source of the seventh TFT is connected to a second circuit point;

an eighth TFT, a drain and a grid of the eighth TFT are connected to each other, and the drain and the grid of the eighth TFT both are connected to the second clock signal, a source of the eighth TFT is connected to a grid of the seventh TFT;

a ninth TFT, a drain of the ninth TFT is connected to a source of the eighth TFT, and a grid of the ninth TFT is connected to the precharge signal, a source of the ninth TFT is connected to a DC low voltage signal;

a tenth TFT, a drain of the tenth TFT is connected to the second circuit point, and a grid of the tenth TFT is connected the precharge signal, a source of tenth TFT is connected to the DC low voltage signal;

an eleventh TFT, a drain of the eleventh TFT is connected to a outputting signal of grid of the eleventh TFT, and a grid of the eleventh TFT is connected to the second circuit point, and a source of the eleventh TFT is connected to a second reverse clock signal;

a twelfth TFT, a drain of the twelfth TFT is connected to the precharge signal, and a grid of the twelfth TFT is connected to a second circuit point, a source of the twelfth TFT is connected to the second reverse clock signal;

wherein the second clock signal and the first clock signal have difference potentials at each of the same clock in correspondingly position, and the second clock signal and the second reverse clock signal have difference potentials at each of the same clock in correspondingly position.

In an embodiment, the first reverse clock signal and the second clock signal have same frequency and potential.

In an embodiment, the first reverse clock signal and the second clock signal from the same signal source.

In an embodiment, the second reverse clock signal and the first clock signal have same frequency and potential.

In an embodiment, the second reverse clock signal and the first clock signal from the same signal source.

In an embodiment, when potential of the first clock signal and the second reverse clock signal both are 28V or 8V, potential of the second clock signal or the first reverse clock signal both are −8V; or when potential of the first clock signal or the second reverse clock signal both are −8V, the potential of the second clock signal and the first reverse clock signal are 28V or 8V.

In an embodiment, the pull-up circuit of the N-stage GOA unit includes a thirteenth TFT, a drain of the thirteenth TFT is connected to a N-stage clock signal, and a grid of the thirteenth TFT is connected to the precharge signal, a source of the thirteenth TFT is connected to an outputting signal of a grid of the thirteenth TFT.

In an embodiment, the pull-down circuit of the N-stage GOA unit includes a fourteenth TFT and a fifteenth TFT; wherein a drain of the fourteenth TFT is connected to an outputting signal of a grid of the fourteenth TFT, a grid of the fourteenth TFT is connected to an outputting signal of a grid of N+1-stage GOA unit, a source of the fourteenth TFT is connected to the DC low voltage signal;

a drain of the fifteenth TFT is connected to the precharge signal, and a grid of the fifteenth TFT is simultaneously connected to the outputting signal of a grid of N+1-stage GOA unit and a grid of the fourteenth, a source of the fifteenth TFT is connected to the DC low voltage signal.

According to another aspect of the disclosure, the disclosure further provides a liquid crystal panel. The liquid crystal panel comprises a GOA circuit, the GOA circuit comprising multiple cascaded GOA units, each stage of the GOA unit outputting a row-scan signal to a row pixel unit which corresponding to a display region in display panel according to a N-staged GOA unit; the N-staged GOA unit comprises a pull-up control circuit, a pull-up circuit, a transmission circuit, a pull-down circuit, a pull-down holding circuit and a bootstrap capacitor, and N is positive integer; wherein the pull-down holding circuit includes a first pull-down holding sub-circuit and a second pull-down holding sub-circuit which work alternatively; wherein the first pull-down holding sub-circuit includes:

a first TFT, a drain of the first TFT is connected to a first clock signal, and a source of the first TFT is connected to a first circuit point;

a second TFT, a drain and a grid of the second TFT are connected to each other, and the drain and the grid of the second TFT both are connected to the first clock signal, a source of the second TFT is connected to a grid of the first TFT;

a third TFT, a drain of the third TFT is connected to a source of the second TFT, and a grid of the third TFT is connected to a precharge signal, a source of the third TFT is connected to a DC low voltage signal;

a fourth TFT, a drain of the fourth TFT is connected to the first circuit point, and a grid of the fourth TFT is connected the precharge signal, a source of fourth TFT is connected to the DC low voltage signal;

a fifth TFT, a drain of the fifth TFT is connected to an outputting signal of grid of the fifth TFT, and a grid of the fifth TFT is connected to the first circuit point, and a source of the fifth TFT is connected to a first reverse clock signal;

a sixth TFT, a drain of the sixth TFT is connected to the precharge signal, and a grid of the sixth TFT is connected to a first circuit point, a source of the sixth TFT is connected to the first reverse clock signal;

wherein the first reverse clock signal has difference potential between the correspondingly positioned first clock signal at the same clock;

the second pull-down holding sub-circuit includes:

a seventh TFT, a drain of the seventh TFT is connected to a second clock signal, and a source of the seventh TFT is connected to a second circuit point;

an eighth TFT, a drain and a grid of the eighth TFT are connected to each other, and the drain and the grid of the eighth TFT both are connected to the second clock signal, a source of the eighth TFT is connected to a grid of the seventh TFT;

a ninth TFT, a drain of the ninth TFT is connected to a source of the eighth TFT, and a grid of the ninth TFT is connected to the precharge signal, a source of the ninth TFT is connected to a DC low voltage signal;

a tenth TFT, a drain of the tenth TFT is connected to the second circuit point, and a grid of the tenth TFT is connected the precharge signal, a source of tenth TFT is connected to the DC low voltage signal;

an eleventh TFT, a drain of the eleventh TFT is connected to an outputting signal of grid of the eleventh TFT, and a grid of the eleventh TFT is connected to the second circuit point, and a source of the eleventh TFT is connected to a second reverse clock signal;

a twelfth TFT, a drain of the twelfth TFT is connected to the precharge signal, and a grid of the twelfth TFT is connected to a second circuit point, a source of the twelfth TFT is connected to the second reverse clock signal;

wherein the second clock signal and the first clock signal have difference potentials at each of the same clock in correspondingly position, and the second clock signal and the second reverse clock signal have difference potentials at each of the same clock in correspondingly position.

In an embodiment, the first reverse clock signal and the second clock signal have same frequency and potential, the first reverse clock signal and the second clock signal from the same signal source.

In an embodiment, the second reverse clock signal and the first clock signal have same frequency and potential, the second reverse clock signal and the first clock signal from the same signal source.

In an embodiment, when potential of the first clock signal and the second reverse clock signal both are 28V or 8V, potential of the second dock signal or the first reverse clock signal both are −8V; or when potential of the first clock signal or the second reverse clock signal both are −8V, the potential of the second clock signal and the first reverse dock signal are 28V or 8V.

According to another aspect of the disclosure, the disclosure yet further provides a display device comprising a liquid crystal panel, the liquid crystal panel comprises a GOA circuit: wherein, the GOA circuit comprising multiple cascaded GOA units, each stage of the GOA unit outputting a row-scan signal to a row pixel unit which corresponding to a display region in display panel according to a N-staged GOA unit; the N-staged GOA unit comprises a pull-up control circuit, a pull-up circuit, a transmission circuit, a pull-down circuit, a pull-down holding circuit and a bootstrap capacitor, and N is positive integer; wherein the pull-down holding circuit includes a first pull-down holding sub-circuit and a second pull-down holding sub-circuit which work alternatively; wherein the first pull-down holding sub-circuit includes:

a first TFT, a drain of the first TFT is connected to a first clock signal, and a source of the first TFT is connected to a first circuit point;

a second TFT, a drain and a grid of the second TFT are connected to each other, and the drain and the grid of the second TFT both are connected to the first clock signal, a source of the second TFT is connected to a grid of the first TFT;

a third TFT, a drain of the third TFT is connected to a source of the second TFT, and a grid of the third TFT is connected to a precharge signal, a source of the third TFT is connected to a DC low voltage signal;

a fourth TFT, a drain of the fourth TFT is connected to the first circuit point, and a grid of the fourth TFT is connected the precharge signal, a source of fourth TFT is connected to the DC low voltage signal;

a fifth TFT, a drain of the fifth TFT is connected to an outputting signal of grid of the fifth TFT, and a grid of the fifth TFT is connected to the first circuit point, and a source of the fifth TFT is connected to a first reverse clock signal;

a sixth TFT, a drain of the sixth TFT is connected to the precharge signal, and a grid of the sixth TFT is connected to a first circuit point, a source of the sixth TFT is connected to the first reverse clock signal;

wherein the first reverse clock signal has difference potential between the correspondingly positioned first clock signal at the same clock;

the second pull-down holding sub-circuit includes:

a seventh TFT, a drain of the seventh TFT is connected to a second clock signal, and a source of the seventh TFT is connected to a second circuit point;

an eighth TFT, a drain and a grid of the eighth TFT are connected to each other, and the drain and the grid of the eighth TFT both are connected to the second clock signal, a source of the eighth TFT is connected to a grid of the seventh TFT;

a ninth TFT, a drain of the ninth TFT is connected to a source of the eighth TFT, and a grid of the ninth TFT is connected to the precharge signal, a source of the ninth TFT is connected to a DC low voltage signal;

a tenth TFT, a drain of the tenth TFT is connected to the second circuit point, and a grid of the tenth TFT is connected the precharge signal, a source of tenth TFT is connected to the DC low voltage signal;

an eleventh TFT, a drain of the eleventh TFT is connected to an outputting signal of grid of the eleventh TFT, and a grid of the eleventh TFT is connected to the second circuit point, and a source of the eleventh TFT is connected to a second reverse clock signal;

a twelfth TFT, a drain of the twelfth TFT is connected to the precharge signal, and a grid of the twelfth TFT is connected to a second circuit point, a source of the twelfth TFT is connected to the second reverse clock signal;

wherein the second clock signal and the first clock signal have difference potentials at each of the same clock in correspondingly position, and the second clock signal and the second reverse clock signal have difference potentials at each of the same clock in correspondingly position.

In an embodiment, the first reverse clock signal and the second clock signal have same frequency and potential.

In an embodiment, the first reverse clock signal and the second clock signal from the same signal source.

In an embodiment, the second reverse clock signal and the first clock signal have same frequency and potential.

In an embodiment, the second reverse clock signal and the first clock signal from the same signal source.

In an embodiment, when potential of the first clock signal and the second reverse clock signal both are 28V or 8V, potential of the second clock signal or the first reverse clock signal both are −8V; or when potential of the first clock signal or the second reverse clock signal both are −8V, the potential of the second clock signal and the first reverse clock signal are 28V or 8V.

In an embodiment, the pull-up circuit of the N-stage GOA unit includes a thirteenth TFT, a drain of the thirteenth TFT is connected to a N-stage clock signal, and a grid of the thirteenth TFT is connected to the precharge signal, a source of the thirteenth TFT is connected to an outputting signal of a grid of the thirteenth TFT.

In an embodiment, the pull-down circuit of the N-stage GOA unit includes a fourteenth TFT and a fifteenth TFT; wherein a drain of the fourteenth TFT is connected to an outputting signal of a grid of the fourteenth TFT, a grid of the fourteenth TFT is connected to an outputting signal of a grid of N+1-stage GOA unit, a source of the fourteenth TFT is connected to the DC low voltage signal;

a drain of the fifteenth TFT is connected to the precharge signal, and a grid of the fifteenth TFT is simultaneously connected to the outputting signal of a grid of N+1-stage GOA unit and a grid of the fourteenth, a source of the fifteenth TFT is connected to the DC low voltage signal.

The advantageous of the embodiment in the present invention is:

In the embodiment of the present invention. To transmit the DC low voltage signal connected by source of TFT T32 and T42 which corresponding to the pull-down holding sub-circuit of the pull-down holding circuit of each stage GOA unit to a first reverse clock signal which has smaller stress effect, and transmit the DC low voltage signal connected by source of TFT T33 and T43 which corresponding to another pull-down holding sub-circuit to a second reverse clock signal which has smaller stress effect. Therefore, each single stage GOA unit could alternatively correcting the problem of forward deflection of voltage threshold on the TFT which corresponding to the pull-down holding sub-circuit in un-working status, which reduces entire stress effect of pull-down holding circuit. It could effective reverse correcting the problem of forward deflection of voltage threshold in the pull-down holding sub-circuit of single-stage GOA unit, such that enhances the reliability and stability of GOA circuit.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The specific structural and functional details disclosed herein are only representative and are intended for describing exemplary embodiments of the disclosure. However, the disclosure can be embodied in many forms of substitution, and should not be interpreted as merely limited to the embodiments described herein.

The disclosure will be further described in detail with reference to accompanying drawings and preferred embodiments as follows.

In first embodiment of the present invention, a GOA circuit comprising multiple cascaded GOA units, each stage of the GOA unit outputting a row-scan signal to a row pixel unit which corresponding to a display region in display panel according to a N-staged GOA unit. For convince described, the following description use the N-stage GOA unit to illustration.

Figure 1:
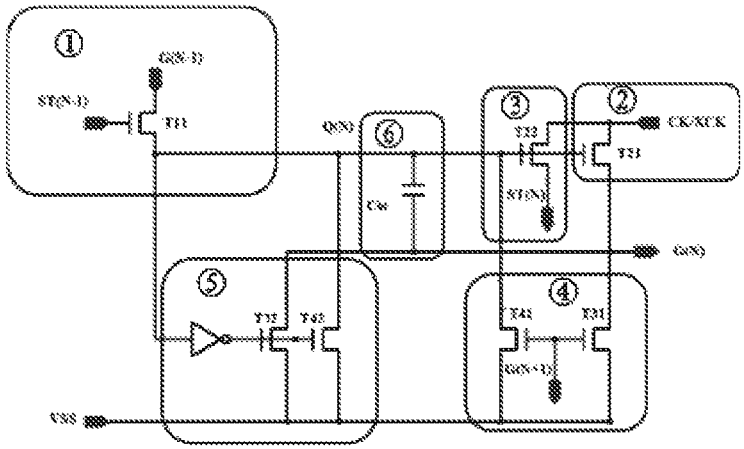
FIG. 1 is a prior art circuit diagram of a GOA circuit.
Figure 2:
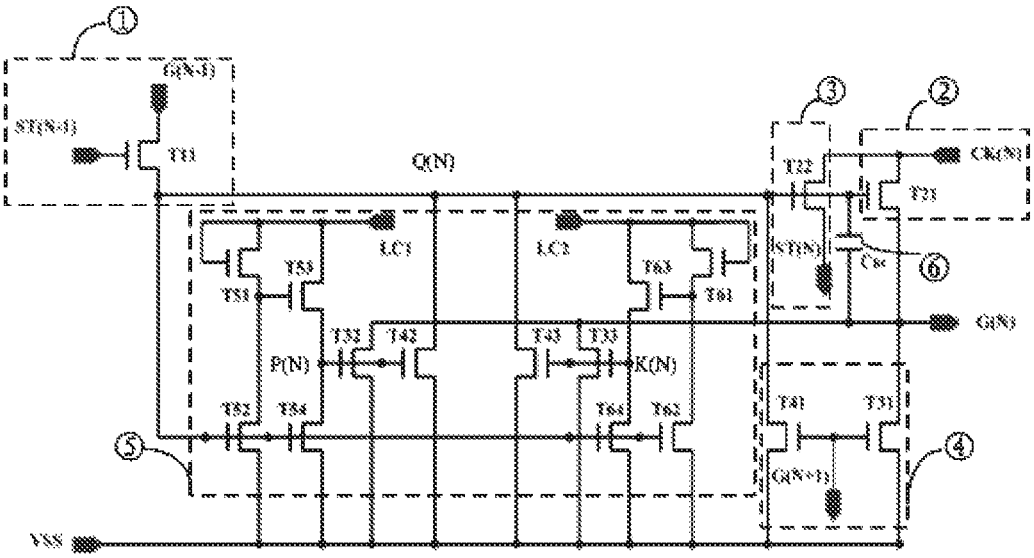
FIG. 2 is a prior art circuit diagram of another GOA circuit.
Figure 3:
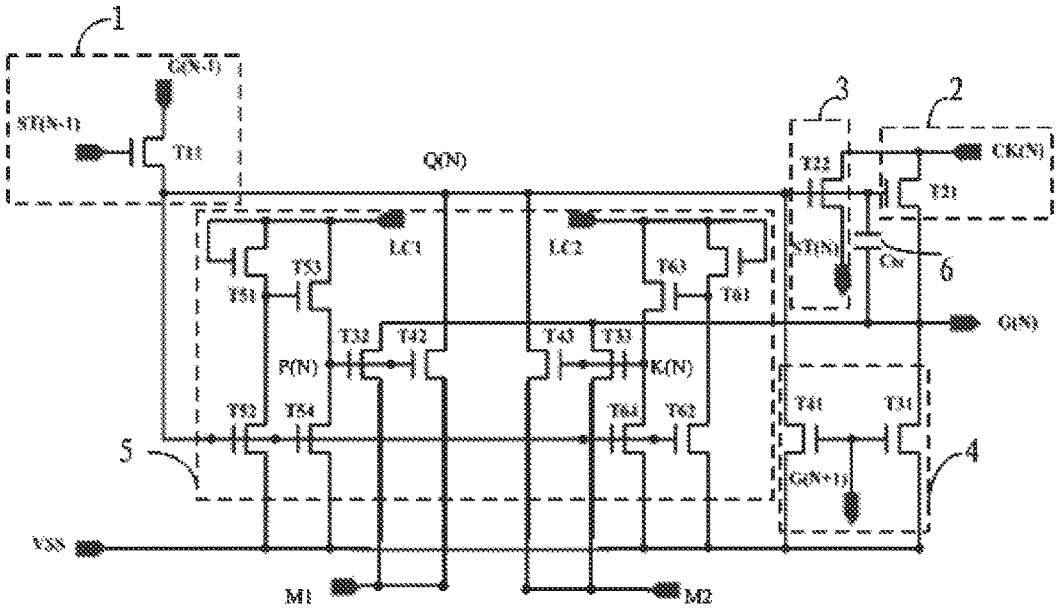
FIG. 3 is a circuit diagram of a stage GOA unit of a GOA circuit according to first embodiment of the disclosure.

Please refer to FIG. 3. The N-staged GOA unit comprises a pull-up control circuit 1, a pull-up circuit 2, a transmission circuit 3, a pull-down circuit 4, a pull-down holding circuit 5 and a bootstrap capacitor 6, and N is positive integer.

The pull-down holding circuit 5 includes a first pull-down holding sub-circuit and a second pull-down holding sub-circuit which work alternatively.

The first pull-down holding sub-circuit includes:

a first TFT T53, a drain of the first TFT T53 is connected to a first clock signal LC1, and a source of the first TFT T53 is connected to a first circuit point P(N);

a second TFT T51, a drain and a grid of the second TFT T51 are connected to each other, and the drain and the grid of the second TFT T51 both are connected to the first clock signal LC1, a source of the second TFT T51 is connected to a grid of the first TFT T53;

a third TFT T52, a drain of the third TFT T52 is connected to a source of the second TFT T51, and a grid of the third TFT T52 is connected to a precharge signal Q(N), a source of the third TFT T52 is connected to a DC low voltage signal VSS;

a fourth TFT T54, a drain of the fourth TFT T54 is connected to the first circuit point P(N), and a grid of the fourth TFT T54 is connected the precharge signal Q(N), a source of fourth TFT T54 is connected to the DC low voltage signal VSS;

a fifth TFT (T32), a drain of the fifth TFT T32 is connected to an outputting signal G(N) of grid of the fifth TFT T32, and a grid of the fifth TFT T32 is connected to the first circuit point P(N), and a source of the fifth TFT T32 is connected to a first reverse clock signal M1;

a sixth TFT T42, a drain of the sixth TFT T42 is connected to the precharge signal Q(N), and a grid of the sixth TFT T42 is connected to a first circuit point P(N), a source of the sixth TFT T42 is connected to the first reverse clock signal M1;

wherein the first reverse clock signal M1 and the first clock signal LC1 have difference potential at each of the same clock in correspondingly position;

the second pull-down holding sub-circuit includes:

a seventh TFT T63, a drain of the seventh TFT T63 is connected to a second clock signal LC2, and a source of the seventh TFT T63 is connected to a second circuit point K(N);

an eighth TFT T61, a drain and a grid of the eighth TFT T61 are connected to each other, and the drain and the grid of the eighth TFT T61 both are connected to the second clock signal LC2, a source of the eighth TFT T61 is connected to a grid of the seventh TFT T63;

a ninth TFT T62, a drain of the ninth TFT T62 is connected to a source of the eighth TFT T61, and a grid of the ninth TFT T62 is connected to the precharge signal Q(N), a source of the ninth TFT T62 is connected to a DC low voltage signal VSS;

a tenth TFT T64, a drain of the tenth TFT T64 is connected to the second circuit point K(N), and a grid of the tenth TFT T64 is connected the precharge signal Q(N), a source of tenth TFT T64 is connected to the DC low voltage signal VSS;

an eleventh TFT T33, a drain of the eleventh TFT T33 is connected to an outputting signal G(N) of grid of the eleventh TFT T33, and a grid of the eleventh TFT T33 is connected to the second circuit point K(N), and a source of the eleventh TFT T33 is connected to a second reverse clock signal M2;

a twelfth TFT T43, a drain of the twelfth TFT T43 is connected to the precharge signal Q(N), and a grid of the twelfth TFT T43 is connected to a second circuit point K(N), a source of the twelfth TFT T43 is connected to the second reverse clock signal M2;

wherein the second clock signal LC2 and the first clock signal LC1 have difference potentials at each of the same clock in correspondingly position, and the second clock signal LC2 and the second reverse clock signal M2 have difference potentials at each of the same clock in correspondingly position.

Figure 4:
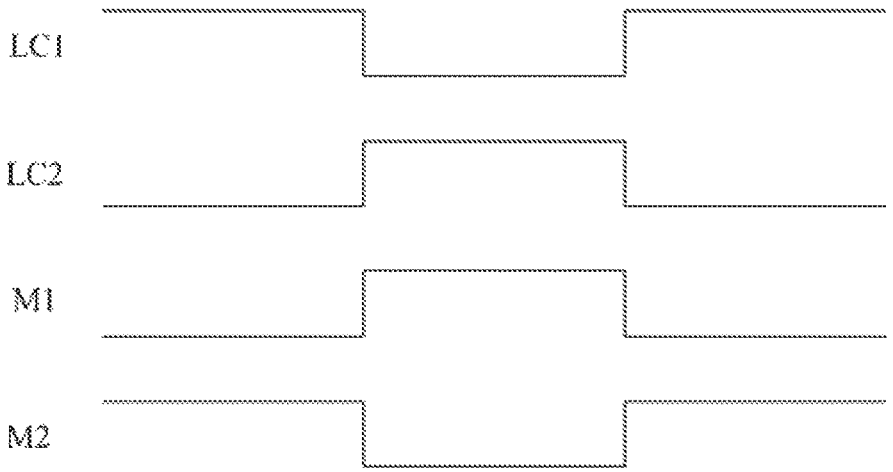
FIG. 4 is an outputting oscillogram of each signal of the pull-down holding circuit in the stage GOA unit shown in FIG. 3.

In first embodiment of this present invention, even though traditional pull-sown holding circuit 5 pull in two pull-down holding sub-circuit by alternatively work (which is the first pull-down holding sub-circuit and the second pull-down holding sub-circuit), and also using the first clock signal LC1 and the second clock signal LC 2 which are reverse to each other (which at the same clock, the first clock signal LC1 outputting voltage wave is potential and the second clock signal LC2 outputting voltage wave is negative potential, and vice versa) for decreasing forward deflection problem of the TFT which corresponding to pull-down holding circuit 5, but could not reverse correcting the forward deflection. Therefore, reverse correcting the forward deflection by pull in the first reverse dock signal M1 and the second reverse clock signal M2 for pull-down holding sub-circuit. At this time, the TFT corresponding to the pull-up holding circuit 5 is not connected to DC low voltage dock, but connected to correspondingly reverse clock signal and made the pull holding sub-circuit in work could keep in working status, and another pull holding sub-circuit in un-work could reduce stress effect of TFT, which is reverse correcting the forward deflection FIG. 4 is an outputting oscillogram of the pull-down holding circuit 5 in the N-stage GOA unit. When the first dock signal LC1 of the first pull-down holding sub-circuit is high potential during a period time (at this time, the first pull-down holding sub-circuit is working and the second pull-down holding sub-circuit is not working), and then during the same time, the first reverse dock signal M1 is low potential, the second dock signal LC2 is low potential, the second reverse clock signal M2 is high potential (at this time, reverse correcting the problem of forward deflection in the second pull-down holding sub-circuit). As the same, when the first clock signal LC1 of the first pull-down holding sub-circuit is low potential during a period time, the first reverse clock signal M1 during the same time is high potential (at this time, reverse correcting the problem of forward deflection in the first pull-down holding sub-circuit), and the second clock signal LC2 is also high potential (at this time, the first pull-down holding sub-circuit is not working and the second pull-down holding sub-circuit is working), the second reverse clock signal M2 is low potential.

In first embodiment of the present invention, the first reverse clock signal M1 and the second clock signal LC2 have same frequency with same potential, or same frequency with difference potentials (but the potential cannot be different). Similarly, the second reverse clock signal M2 and the first clock signal LC1 have same frequency with same potential, or same frequency with difference potentials (but the potential cannot be different).

If the GOA circuit space has limitation, the first reverse clock signal M1 and the second clock signal LC2 have same frequency with same potential, and from the same signal source. Which is the first reverse clock signal M1 could directly uses the second clock signal LC2; the second reverse clock signal M2 and the first clock signal LC1 also have same frequency with same potential, and from the same signal source. Which is the second reverse clock signal M2 could directly uses the first clock signal LC1. For example, potential of the first clock signal LC1 and the second reverse clock signal M2 are same, 28V or 8V, and the potential of the second clock signal LC2 and the first reverse clock signal M1 are same, −8V; Or, potential of the first clock signal LC1 and the second reverse dock signal M2 are same, −8V, and the potential of the second clock signal LC2 and the first reverse clock signal M1 are same, 28V or 8V.

If the GOA circuit has enough space, the first reverse clock signal M1 and the second clock signal LC2 have same frequency with difference potentials; the second reverse clock signal M2 and the first clock signal LC1 have same frequency with difference potentials. For example, when the first clock signal LC1 is 28V or 8V, the first reverse clock signal is −5V, the second clock signal LC2 is −8V, the second reverse clock signal is +10V; Or, when the first clock signal LC1 is −8V, the first reverse clock signal is +5V, the second clock signal LC2 is 28V or 8V, the second reverse clock signal is −10V.

In first embodiment of the present invention, the pull-up circuit 2 of the N-stage GOA unit includes a thirteenth TFT T21, a drain of the thirteenth TFT T21 is connected to a N-stage dock signal CK(N), and a grid of the thirteenth TFT T21 is connected to the precharge signal Q(N), a source of the thirteenth TFT T21 is connected to an outputting signal G(N) of a grid of the thirteenth TFT T21.

In first embodiment of the present invention, the pull-down circuit of the N-stage GOA unit includes a fourteenth TFT T31 and a fifteenth TFT T41;

a drain of the fourteenth TFT T31 is connected to an outputting signal G(N) of a grid of the fourteenth TFT T31, a grid of the fourteenth TFT T31 is connected to an outputting signal G(N+1) of a grid of N+1-stage GOA unit, a source of the fourteenth TFT T31 is connected to the DC low voltage signal VSS;

a drain of the fifteenth TFT T41 is connected to the precharge signal Q(N), and a grid of the fifteenth TFT T41 is simultaneously connected to the outputting signal G(N+1) of a grid of N+1-stage GOA unit and a grid of the fourteenth TFT T41, a source of the fifteenth TFT T41 is connected to the DC low voltage signal VSS.

According to the GOA circuit of the first embodiment in this present invention, the second embodiment provides a liquid crystal panel, which comprises the GOA circuit of the first embodiment, and the structure and connection of the GOA circuit is similar to that of the GOA circuit, please refer to the previously described for the first embodiment, here will not repeat again.

According to the GOA circuit of the second embodiment in this present invention, the third embodiment provides a display panel, which comprises the liquid crystal panel of the second embodiment, and the structure and connection of the liquid crystal panel is similar to that of the liquid crystal panel, please refer to the previously described for the second embodiment, here will not repeat again.

In sum, to transmit the DC low voltage signal connected by source of TFT T32 and T42 which corresponding to the pull-down holding sub-circuit of the pull-down holding circuit of each stage GOA unit to a first reverse clock signal which has smaller stress effect, and transmit the DC low voltage signal connected by source of TFT T33 and T43 which corresponding to another pull-down holding sub-circuit to a second reverse clock signal which has smaller stress effect. Therefore, each single stage GOA unit could alternatively correcting the problem of forward deflection of voltage threshold on the TFT which corresponding to the pull-down holding sub-circuit in un-working status, which reduces entire stress effect of pull-down holding circuit. It could effective reverse correcting the problem of forward deflection of voltage threshold in the pull-down holding sub-circuit of single-stage GOA unit, such that enhances the reliability and stability of GOA circuit.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A GOA circuit, comprising multiple cascaded GOA units, each stage of the GOA unit outputting a row-scan signal to a row pixel unit which corresponding to a display region in display panel according to a N-staged GOA unit; the N-staged GOA unit comprises a pull-up control circuit, a pull-up circuit, a transmission circuit, a pull-down circuit, a pull-down holding circuit and a bootstrap capacitor, and N is positive integer; wherein the pull-down holding circuit includes a first pull-down holding sub-circuit and a second pull-down holding sub-circuit which work alternatively; wherein the first pull-down holding sub-circuit includes:

a first TFT, a drain of the first TFT is connected to a first dock signal, and a source of the first TFT is connected to a first circuit point;

a second TFT, a drain and a grid of the second TFT are connected to each other, and the drain and the grid of the second TFT both are connected to the first dock signal, a source of the second TFT is connected to a grid of the first TFT;

a third TFT, a drain of the third TFT is connected to a source of the second TFT, and a grid of the third TFT is connected to a precharge signal, a source of the third TFT is connected to a DC low voltage signal;

a fourth TFT, a drain of the fourth TFT is connected to the first circuit point, and a grid of the fourth TFT is connected the precharge signal, a source of fourth TFT is connected to the DC low voltage signal;

a fifth TFT, a drain of the fifth TFT is connected to an outputting signal of grid of the fifth TFT, and a grid of the fifth TFT is connected to the first circuit point, and a source of the fifth TFT is connected to a first reverse dock signal;

a sixth TFT, a drain of the sixth TFT is connected to the precharge signal, and a grid of the sixth TFT is connected to a first circuit point, a source of the sixth TFT is connected to the first reverse clock signal;

wherein the first reverse dock signal and the first dock signal have difference potential at each of the same clock in correspondingly position;

the second pull-down holding sub-circuit includes:

a seventh TFT, a drain of the seventh TFT is connected to a second clock signal, and a source of the seventh TFT is connected to a second circuit point;

an eighth TFT, a drain and a grid of the eighth TFT are connected to each other, and the drain and the grid of the eighth TFT both are connected to the second clock signal, a source of the eighth TFT is connected to a grid of the seventh TFT;

a ninth TFT, a drain of the ninth TFT is connected to a source of the eighth TFT, and a grid of the ninth TFT is connected to the precharge signal, a source of the ninth TFT is connected to a DC low voltage signal;

a tenth TFT, a drain of the tenth TFT is connected to the second circuit point, and a grid of the tenth TFT is connected the precharge signal, a source of tenth TFT is connected to the DC low voltage signal;

an eleventh TFT, a drain of the eleventh TFT is connected to an outputting signal of grid of the eleventh TFT, and a grid of the eleventh TFT is connected to the second circuit point, and a source of the eleventh TFT is connected to a second reverse clock signal;

a twelfth TFT, a drain of the twelfth TFT is connected to the precharge signal, and a grid of the twelfth TFT is connected to a second circuit point, a source of the twelfth TFT is connected to the second reverse clock signal;

wherein the second clock signal and the first clock signal have difference potentials at each of the same clock in correspondingly position, and the second clock signal and the second reverse clock signal have difference potentials at each of the same clock in correspondingly position.

2. The GOA circuit according to claim 1, wherein the first reverse clock signal and the second clock signal have same frequency and potential.

3. The GOA circuit according to claim 2, wherein the first reverse clock signal and the second clock signal from the same signal source.

4. The GOA circuit according to claim 3, wherein the second reverse clock signal and the first clock signal have same frequency and potential.

5. The GOA circuit according to claim 4, wherein the second reverse clock signal and the first clock signal from the same signal source.

6. The GOA circuit according to claim 5, wherein when potential of the first clock signal and the second reverse clock signal both are 28V or 8V, potential of the second clock signal or the first reverse clock signal both are −8V; or when potential of the first clock signal or the second reverse clock signal both are −8V, the potential of the second clock signal and the first reverse clock signal are 28V or 8V.

7. The GOA circuit according to claim 6, wherein the pull-up circuit of the N-stage GOA unit includes a thirteenth TFT, a drain of the thirteenth TFT is connected to a N-stage clock signal, and a grid of the thirteenth TFT is connected to the precharge signal, a source of the thirteenth TFT is connected to an outputting signal of a grid of the thirteenth TFT.

8. The GOA circuit according to claim 7, wherein the pull-down circuit of the N-stage GOA unit includes a fourteenth TFT and a fifteenth TFT; wherein a drain of the fourteenth TFT is connected to an outputting signal of a grid of the fourteenth TFT, a grid of the fourteenth TFT is connected to an outputting signal of a grid of N+1-stage GOA unit, a source of the fourteenth TFT is connected to the DC low voltage signal;

a drain of the fifteenth TFT is connected to the precharge signal, and a grid of the fifteenth TFT is simultaneously connected to the outputting signal of a grid of N+1-stage GOA unit and a grid of the fourteenth, a source of the fifteenth TFT is connected to the DC low voltage signal.

9. A liquid crystal panel, comprises a GOA circuit, the GOA circuit comprising multiple cascaded GOA units, each stage of the GOA unit outputting a row-scan signal to a row pixel unit which corresponding to a display region in display panel according to a N-staged GOA unit; the N-staged GOA unit comprises a pull-up control circuit, a pull-up circuit, a transmission circuit, a pull-down circuit, a pull-down holding circuit and a bootstrap capacitor, and N is positive integer wherein the pull-down holding circuit includes a first pull-down holding sub-circuit and a second pull-down holding sub-circuit which work alternatively; wherein the first pull-down holding sub-circuit includes:

a first TFT, a drain of the first TFT is connected to a first clock signal, and a source of the first TFT is connected to a first circuit point;

a second TFT, a drain and a grid of the second TFT are connected to each other, and the drain and the grid of the second TFT both are connected to the first clock signal, a source of the second TFT is connected to a grid of the first TFT;

a third TFT, a drain of the third TFT is connected to a source of the second TFT, and a grid of the third TFT is connected to a precharge signal, a source of the third TFT is connected to a DC low voltage signal;

a fourth TFT, a drain of the fourth TFT is connected to the first circuit point, and a grid of the fourth TFT is connected the precharge signal, a source of fourth TFT is connected to the DC low voltage signal;

a fifth TFT, a drain of the fifth TFT is connected to an outputting signal of grid of the fifth TFT, and a grid of the fifth TFT is connected to the first circuit point, and a source of the fifth TFT is connected to a first reverse clock signal;

a sixth TFT, a drain of the sixth TFT is connected to the precharge signal, and a grid of the sixth TFT is connected to a first circuit point, a source of the sixth TFT is connected to the first reverse clock signal;

wherein the first reverse clock signal and the first clock signal have difference potential at each of the same clock in correspondingly position;

the second pull-down holding sub-circuit includes:

a seventh TFT, a drain of the seventh TFT is connected to a second clock signal, and a source of the seventh TFT is connected to a second circuit point;

an eighth TFT, a drain and a grid of the eighth TFT are connected to each other, and the drain and the grid of the eighth TFT both are connected to the second clock signal, a source of the eighth TFT is connected to a grid of the seventh TFT;

a ninth TFT, a drain of the ninth TFT is connected to a source of the eighth TFT, and a grid of the ninth TFT is connected to the precharge signal, a source of the ninth TFT is connected to a DC low voltage signal;

a tenth TFT, a drain of the tenth TFT is connected to the second circuit point, and a grid of the tenth TFT is connected the precharge signal, a source of tenth TFT is connected to the DC low voltage signal;

an eleventh TFT, a drain of the eleventh TFT is connected to an outputting signal of grid of the eleventh TFT, and a grid of the eleventh TFT is connected to the second circuit point, and a source of the eleventh TFT is connected to a second reverse clock signal;

a twelfth TFT, a drain of the twelfth TFT is connected to the precharge signal, and a grid of the twelfth TFT is connected to a second circuit point, a source of the twelfth TFT is connected to the second reverse clock signal;

wherein the second clock signal and the first clock signal have difference potentials at each of the same clock in correspondingly position, and the second clock signal and the second reverse clock signal have difference potentials at each of the same clock in correspondingly position.

10. The liquid crystal panel according to claim 9, wherein the first reverse clock signal and the second clock signal have same frequency and potential, the first reverse clock signal and the second clock signal from the same signal source.

11. The liquid crystal panel according to claim 10, wherein the second reverse clock signal and the first clock signal have same frequency and potential, the second reverse clock signal and the first clock signal from the same signal source.

12. The liquid crystal panel according to claim 11, wherein when potential of the first clock signal and the second reverse clock signal both are 28V or 8V, potential of the second clock signal or the first reverse clock signal both are −8V; or when potential of the first clock signal or the second reverse clock signal both are −8V, the potential of the second clock signal and the first reverse clock signal are 28V or 8V.

13. A display device comprising a liquid crystal panel, the liquid crystal panel comprises a GOA circuit: wherein, the GOA circuit comprising multiple cascaded GOA units, each stage of the GOA unit outputting a row-scan signal to a row pixel unit which corresponding to a display region in display panel according to a N-staged GOA unit; the N-staged GOA unit comprises a pull-up control circuit, a pull-up circuit, a transmission circuit, a pull-down circuit, a pull-down holding circuit and a bootstrap capacitor, and N is positive integer; wherein the pull-down holding circuit includes a first pull-down holding sub-circuit and a second pull-down holding sub-circuit which work alternatively; wherein the first pull-down holding sub-circuit includes:

a first TFT, a drain of the first TFT is connected to a first clock signal, and a source of the first TFT is connected to a first circuit point;

a second TFT, a drain and a grid of the second TFT are connected to each other, and the drain and the grid of the second TFT both are connected to the first clock signal, a source of the second TFT is connected to a grid of the first TFT;

a third TFT, a drain of the third TFT is connected to a source of the second TFT, and a grid of the third TFT is connected to a precharge signal, a source of the third TFT is connected to a DC low voltage signal;

a fourth TFT, a drain of the fourth TFT is connected to the first circuit point, and a grid of the fourth TFT is connected the precharge signal, a source of fourth TFT is connected to the DC low voltage signal;

a fifth TFT, a drain of the fifth TFT is connected to an outputting signal of grid of the fifth TFT, and a grid of the fifth TFT is connected to the first circuit point, and a source of the fifth TFT is connected to a first reverse clock signal;

a sixth TFT, a drain of the sixth TFT is connected to the precharge signal, and a grid of the sixth TFT is connected to a first circuit point, a source of the sixth TFT is connected to the first reverse clock signal;

wherein the first reverse clock signal and the first clock signal have difference potential at each of the same clock in correspondingly position;

the second pull-down holding sub-circuit includes:

a seventh TFT, a drain of the seventh TFT is connected to a second clock signal, and a source of the seventh TFT is connected to a second circuit point;

an eighth TFT, a drain and a grid of the eighth TFT are connected to each other, and the drain and the grid of the eighth TFT both are connected to the second clock signal, a source of the eighth TFT is connected to a grid of the seventh TFT;

a ninth TFT, a drain of the ninth TFT is connected to a source of the eighth TFT, and a grid of the ninth TFT is connected to the precharge signal, a source of the ninth TFT is connected to a DC low voltage signal;

a tenth TFT, a drain of the tenth TFT is connected to the second circuit point, and a grid of the tenth TFT is connected the precharge signal, a source of tenth TFT is connected to the DC low voltage signal;

an eleventh TFT, a drain of the eleventh TFT is connected to an outputting signal of grid of the eleventh TFT, and a grid of the eleventh TFT is connected to the second circuit point, and a source of the eleventh TFT is connected to a second reverse clock signal;

a twelfth TFT, a drain of the twelfth TFT is connected to the precharge signal, and a grid of the twelfth TFT is connected to a second circuit point, a source of the twelfth TFT is connected to the second reverse clock signal;

wherein the second clock signal and the first clock signal have difference potential at each of the same clock in correspondingly position, and the second clock signal and the second reverse clock signal have difference potential at each of the same clock in correspondingly position.

14. The GOA circuit according to claim 13, wherein the first reverse clock signal and the second clock signal have same frequency and potential.

15. The GOA circuit according to claim 14, wherein the first reverse clock signal and the second clock signal from the same signal source.

16. The GOA circuit according to claim 15, wherein the second reverse dock signal and the first clock signal have same frequency and potential.

17. The GOA circuit according to claim 16, wherein the second reverse clock signal and the first clock signal from the same signal source.

18. The GOA circuit according to claim 17, wherein when potential of the first clock signal and the second reverse dock signal both are 28V or 8V, potential of the second clock signal or the first reverse clock signal both are −8V; or when potential of the first clock signal or the second reverse dock signal both are −8V, the potential of the second clock signal and the first reverse clock signal are 28V or 8V.

19. The GOA circuit according to claim 18, wherein the pull-up circuit of the N-stage GOA unit includes a thirteenth TFT, a drain of the thirteenth TFT is connected to a N-stage dock signal, and a grid of the thirteenth TFT is connected to the precharge signal, a source of the thirteenth TFT is connected to an outputting signal of a grid of the thirteenth TFT.

20. The GOA circuit according to claim 19, wherein the pull-down circuit of the N-stage GOA unit includes a fourteenth TFT and a fifteenth TFT; wherein a drain of the fourteenth TFT is connected to an outputting signal of a grid of the fourteenth TFT, a grid of the fourteenth TFT is connected to an outputting signal of a grid of N+1-stage GOA unit, a source of the fourteenth TFT is connected to the DC low voltage signal;

a drain of the fifteenth TFT is connected to the precharge signal, and a grid of the fifteenth TFT is simultaneously connected to the outputting signal of a grid of N+1-stage GOA unit and a grid of the fourteenth, a source of the fifteenth TFT is connected to the DC low voltage signal.

* * * * *